US006805973B2

(12) United States Patent
Kadomura et al.

(10) Patent No.: US 6,805,973 B2
(45) Date of Patent: Oct. 19, 2004

(54) ALUMINUM NITRIDE/ALUMINUM BASE COMPOSITE MATERIAL AND A METHOD FOR PRODUCING THEREOF

(75) Inventors: Shingo Kadomura, Kanagawa (JP); Kei Takatsu, Tokyo (JP); Shinsuke Hirano, Kanagawa (JP); Nobuyuki Suzuki, Shizuoka (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 10/653,357

(22) Filed: Sep. 3, 2003

(65) Prior Publication Data

US 2004/0040687 A1 Mar. 4, 2004

Related U.S. Application Data

(62) Division of application No. 09/187,226, filed on Nov. 6, 1998, now Pat. No. 6,668,905.

(30) Foreign Application Priority Data

Nov. 6, 1997 (JP) ..... 9-304213

(51) Int. Cl.[7] ..... C09J 5/02; B32B 5/22; B32B 15/04; B32B 15/20

(52) U.S. Cl. ..... 428/614; 428/450; 428/539.5; 428/565; 428/698

(58) Field of Search ..... 428/614, 450, 428/539.5, 565, 698

(56) References Cited

U.S. PATENT DOCUMENTS

| | | | | | |
|---|---|---|---|---|---|
| 4,877,759 | A | * | 10/1989 | Holt et al. | 501/98.4 |
| 5,395,701 | A | * | 3/1995 | White et al. | 428/614 |
| 5,418,015 | A | * | 5/1995 | Jackson et al. | 427/452 |
| 5,436,080 | A | * | 7/1995 | Inoue et al. | 428/546 |
| 5,775,403 | A | * | 7/1998 | Premkumar et al. | 164/98 |
| 5,941,297 | A | * | 8/1999 | Young | 164/62 |
| 6,120,661 | A | * | 9/2000 | Hirano et al. | 204/298.15 |
| 6,391,437 | B1 | * | 5/2002 | Kadomura et al. | 428/307.3 |

FOREIGN PATENT DOCUMENTS

| | | | |
|---|---|---|---|
| FR | 2028878 | * | 5/1975 |
| JP | 03-189063 | | 8/1991 |
| JP | 03-189064 | | 8/1991 |

* cited by examiner

*Primary Examiner*—Deborah Jones
*Assistant Examiner*—Jason Savage
(74) *Attorney, Agent, or Firm*—Rader, Fishman & Grauer PLLC; Ronald P. Kananen

(57) ABSTRACT

A method for producing an aluminum nitride/aluminum base composite material comprising the steps of; (A) charging aluminum nitride powder into a container provided in a molten metal pressure apparatus, (B) applying pressure to the aluminum nitride powder in the container, (C) pouring a molten aluminum base material into the container, and, (D) applying pressure to the molten aluminum base material in the container to fill the aluminum base material in space between the aluminum nitride powder particles.

6 Claims, 4 Drawing Sheets

ALUMINUM NITRIDE/ALUMINUM BASE COMPOSITE MATERIAL AND A METHOD FOR PRODUCING THEREOF

This Application is a Divisional Application of Ser. No. 09/187,226 filed Nov. 6, 1998 now U.S. Pat. No. 6,668,905.

BACKGROUND OF THE INVENTION AND RELATED ART

The present invention relates to an aluminum nitride/aluminum base composite material and a method for producing thereof.

A composite material produced by sintering metal powder to obtain a porous metal sintered member, and immersing and solidifying an aluminum base material into pores in the porous metal sintered member, has been known, for example, from Japanese Laid-Open Patent Publications JPA-3-189063 and JPA-3-189064. Such a composite material has attracted a good deal of attention as a novel material and has been expected to be put into practical use in miscellaneous industrial fields including automotive parts for internal combustion engines.

Since such a composite material can have a large specific Young's modulus (Young's modulus divided by density), the composite material has a large characteristic sound velocity and an excellent vibration damping characteristic. Thus, this composite material with an excellent damping property will successfully be applied, for example, to industrial robot arms which move rapidly.

However, in the case where a higher anti-oxidative or anti-corrosive property is required for the composite material disclosed in the above Laid-Open Patent Publications, the composite material needs to be covered with a covering layer consisting of a ceramic material such as $Al_2O_3$ or aluminum nitride. Nevertheless, there is a problem that cracks arise in the covering layer because of difference in the linear expansion coefficients between the composite and ceramic materials, when the composite material covered with the covering layer is rapidly changed in temperature. The composite material is versatile in various applications, besides automotive parts for internal combustion engines or robot arms, depending upon its characteristics, while it is also important to suppress production costs.

OBJECT AND SUMMARY OF THE INVENTION

It is therefore an object of the present invention to provide an aluminum nitride/aluminum base composite material excellent in heat resistance, oxidation resistance and corrosion resistance, and suitable for use in portions or parts of structures for which a higher heat conductivity and a lower linear expansion coefficient are required, and to provide a method for producing thereof.

For achieving the above-described object, there is provided a method for producing an aluminum nitride/aluminum base composite material according to a first aspect of the present invention, which comprises the steps of;

(A) charging aluminum nitride powder into a container provided in a molten metal pressure apparatus, (B) applying pressure to the aluminum nitride powder in the container, (C) pouring a molten aluminum base material into the container, and, (D) applying pressure to the molten aluminum base material in the container to fill the aluminum base material in space between the aluminum nitride powder particles.

For achieving the above-described object, there is provided a method for producing an aluminum nitride/aluminum base composite material according to a second aspect of the present invention, which comprises the steps of;

(A) preparing a preform obtained by sintering aluminum nitride powder, (B) enclosing the preform in a container provided in a molten metal pressure apparatus, (C) pouring a molten aluminum base material into the container, and, (D) applying pressure to the molten aluminum base material in the container to fill the aluminum base material in pores of the preform.

For achieving the above-described object, there is provided a method for producing an aluminum nitride/aluminum base composite material according to a third aspect of the present invention, which comprises the steps of;

(a) charging aluminum nitride powder into a container provided in a molten metal pressure apparatus, applying pressure to the aluminum nitride powder in the container, pouring a molten aluminum base material into the container, and, then, applying pressure to the molten aluminum base material in the container to fill the aluminum base material in space between the aluminum nitride powder particles, thereby obtaining a base material, and (b) covering the surface of the base material with a covering layer consisting of a ceramic material.

For achieving the above-described object, there is provided a method for producing an aluminum nitride/aluminum base composite material according to a fourth aspect of the present invention, which comprises the steps of;

(a) preparing a preform obtained by sintering aluminum nitride powder, enclosing the preform in a container provided in a molten metal pressure apparatus, pouring a molten aluminum base material into the container, and, then, applying pressure to the molten aluminum base material in the container to fill the aluminum base material in pores of the preform, thereby obtaining a base material, and (b) covering the surface of the base material with a covering layer consisting of a ceramic material.

For achieving the above-described object, there is provided an aluminum nitride/aluminum base composite material according to a first aspect of the present invention, which is produced by the steps of;

(A) charging aluminum nitride powder into a container provided in a molten metal pressure apparatus, (B) applying pressure to the aluminum nitride powder in the container, (C) pouring a molten aluminum base material into the container, and, (D) applying pressure to the molten aluminum base material in the container to fill the aluminum base material in space between the aluminum nitride powder particles.

For achieving the above-described object, there is provided an aluminum nitride/aluminum base composite material according to a second aspect of the present invention, which is produced by the steps of;

(A) preparing a preform obtained by sintering aluminum nitride powder, (B) enclosing the preform in a container provided in a molten metal pressure apparatus, (C) pouring a molten aluminum base material into the container, and, (D) applying pressure to the molten aluminum base material in the container to fill the aluminum base material in pores of the preform.

For achieving the above-described object, there is provided an aluminum nitride/aluminum base composite material according to a third aspect of the present invention, which comprises;

(a) a base material obtained by charging aluminum nitride powder into a container provided in a molten metal pressure apparatus, applying pressure to the aluminum nitride powder in the container, pouring a molten aluminum base material into the container, and, then, applying pressure to the molten aluminum base material in the container to fill the aluminum base material in space between the aluminum nitride powder particles, and (b) a covering layer consisting of a ceramic material and covering the surface of the base material.

For achieving the above-described object, there is provided an aluminum nitride/aluminum base composite material according to a fourth aspect of the present invention, which comprises;

(a) a base material obtained by preparing a preform obtained by sintering aluminum nitride powder, enclosing the preform in a container provided in a molten metal pressure apparatus, pouring a molten aluminum base material into the container, and, applying pressure to the molten aluminum base material in the container to fill the aluminum base material in pores of the preform, and (b) a covering layer consisting of a ceramic material and covering the surface of the base material.

It is preferable to pour a molten aluminum base material together with silicon (Si) to control the linear expansion coefficient of the aluminum nitride/aluminum base composite material or the base material of the present invention. The aluminum nitride/aluminum base composite material according to the first to fourth aspects of the present invention is simply referred to as "the composite material", hereinafter, in some cases. Further, "the composite material" in the phrase "the composite material or the base material" means the aluminum nitride/aluminum base composite material according to the first and second aspects of the present invention, and "the base material" in the phrase "the composite material or the base material" means the base material according to the third and fourth aspects of the present invention. Assuming that the total of the aluminum base material and silicon is 100% in weight, an amount of silicon to be added is preferably in a range from 10 to 35% in weight, more preferably from 16 to 35% in weight, and further preferably from 20 to 35% in weight.

In the aluminum nitride/aluminum base composite material and the method for producing thereof according to the third or fourth aspect of the present invention, it is preferable to satisfy the relation of $(\alpha_1-3)\leqq\alpha_2\leqq(\alpha_1+3)$, where $\alpha_1$ represents the linear expansion coefficient of the base material [unit:$10^{-6}$/K] and $\alpha_2$ represents the linear expansion coefficient of the ceramic material constituting the covering layer [unit:$10^{-6}$/K], for preventing undesirable cracks in the covering layer caused by difference in the linear expansion coefficients between the base material and the ceramic material when rapid change in temperature is given to the base material and the covering layer. An aluminum-containing material is preferable for the ceramic material constituting the covering layer, which is exemplified by $Al_2O_3$ or aluminum nitride (AlN). It is also preferable to add, for example, $TiO_2$ to the ceramic material to control its linear expansion coefficient or electrical characteristics. The surface of the base material can be preferably covered with the covering layer consisting of the ceramic material, for example, by forming the covering layer onto the surface of the base material through a thermal spraying process, or by attaching the covering layer pre-fabricated in a sheet (plate) form onto the surface of the base material through a brazing process. The covering layer may cover the entire surface of the base material or part of the surface. A linear expansion coefficient $\alpha$ is generally expressed as $\alpha=(dL/d\theta)/L_0$, where L is a length of an object, $L_0$ is a length of the object at 0° C., and $\theta$ is temperature.

As the aluminum base material, aluminum alloys properly containing Si, Mg, Ni, Cu or Mg are exemplified besides pure aluminum.

A volume ratio between aluminum nitride and aluminum base material is preferably in a range from 4/6 to 8/2, and more preferably from 6/4 to 7/3. Selecting such volume ratio results in obtaining not only proper control of the linear expansion coefficient of the composite material or the base material, but also in providing the composite material or the base material with an electric conductivity or a heat conductivity more closer to those of metals, rather than to those of pure ceramics.

When the molten aluminum base material is poured into the container, it is preferable to set temperature of the aluminum nitride powder or the preform made of aluminum nitride within a range from 500 to 1000° C., and more preferably from 700 to 800° C. Temperature of the molten aluminum base material at the time of the pouring is preferably set within a range from 700 to 1000° C., and more preferably from 750 to 900° C. Applying pressure to the molten aluminum base material in the container is preferably effected by a high-pressure casting method. It is preferable to set an absolute pressure to be applied to the molten aluminum base material within a range from 200 to 1500 kgf/cm$^2$, and more preferably from 800 to 1000 kgf/cm$^2$.

In the aluminum nitride/aluminum base composite material and the method for producing thereof according to the first or third aspect of the present invention, it is preferable to select an average particle size of aluminum nitride powder in a range from 10 to 100 $\mu$m. It is also allowable to mix aluminum nitride powders different in their average particle sizes and to subject them to the production of the composite material or the base material. Mixing such aluminum nitride powders with different average particle sizes results in a successful control of a pore ratio (porosity) of the composite material or the base material. In this case, provided that one aluminum nitride powder has an average particle size of $R_1$ and the another aluminum nitride powder has an average particle size of $3R_1$ to $5R_1$, the former is preferably mixed with the latter three times to five times in volume to be subjected to the production of the composite material or the base material, while these values being not limitative. Mixing aluminum nitride powders with different particle sizes according to such conditions allows the pore ratio of the composite material or the base material to be minimized.

A preferred container into which the aluminum nitride powder is charged is such that it can yield any desired shape when the pressure is applied to the aluminum nitride powder, which can typically be a casting mold.

An absolute pressure to be applied to the aluminum nitride powder charged into the container may properly be determined based on a required pore ratio of the aluminum nitride powder after the pressure is applied, where a preferable range is from 50 kgf/cm$^2$ to 3 metric tons-f/cm$^2$, and more preferably from 100 kgf/cm$^2$ to 2.5 metric tons-f/cm$^2$.

In the aluminum nitride/aluminum base composite material and the method for producing thereof according to the second or fourth aspect of the present invention, the preform is fabricated by sintering the aluminum nitride powder, the preform being obtained by molding the aluminum nitride powder through, for example, die press forming, hydrostatic forming, casting or slurry casting; and sintering the molded aluminum nitride powder within a range from 500 to 1000° C., or more preferably from 800 to 1000° C. It is desirable that a container for enclosing the preform is typically a casting mold.

The aluminum base material is excellent in terms of a high heat conductivity, while it has defects that it has low resistances against heat, oxidation and corrosion, as well as a linear expansion coefficient as high as $23\times10^{-6}$/K. On the other hand, aluminum nitride (AlN), as is well known, has a relatively high heat conductivity (0.235 cal/cm·sec·K or 98.3 W/m·K) and a relatively low linear expansion coefficient for a ceramic; and because of the nature of ceramic, it has high resistances against heat, oxidation and corrosion. In the present invention, the composite material or the base material comprises a two-component system of aluminum nitride and aluminum base material; and optionally comprises a three-component system of aluminum nitride, aluminum base material and silicon. Therefore, the composite material or the base material of the present invention possesses an intermediate property between those of aluminum nitride and aluminum base material.

Meanwhile, the non-pressurized immersion process is known as a method for producing a composite material constituting a ceramic material and an aluminum base material. In this process, a ceramic preform is heated up around 1200° C. with an environment being conditioned so as to contain Mg (an environment having a partial pressure of Mg of 5 hPa or above, for example) for improving a wetting property of the ceramic material, and the molten aluminum base material is then immersed to be filled in the pores of the preform without applying any pressure. However, there is a problem that the immersion and filling are time-consuming, which increases production costs of the composite material.

The present invention, on the contrary, employs so-called high-pressure casting process to produce the composite material or the base material in a shorter time period.

In the method for producing the aluminum nitride/aluminum base composite material according to the second or fourth aspect of the present invention, a casting mold is previously fabricated and, the preform made of aluminum nitride can readily be formed using such a casting mold. This allows cost-saving in the production of the composite material or the base material.

Although depending upon the shape of the composite material or the base material to be produced, there is a problem on occasions that a crack arises in the preform made of aluminum nitride when pressure is applied to the molten aluminum base material in the container and that the aluminum base material is found in the crack, mainly. In such a case, helpful is the method for producing a aluminum nitride/aluminum base composite material according to the first or third aspect of the present invention. That is, in the above method, the aluminum nitride powder is used as a source material, and pressure is applied to the molten aluminum base material in the container only after pressure is applied to the aluminum nitride powder in the container to be formed into a desired shape or after the aluminum nitride powder is densified and solidified, which surely suppresses the cracks and increase the production yield of the composite material or the base material. Further, the production cost of the composite material or the base material can be also saved since the aluminum nitride powder can be formed into a desired shape while kept staying within the container (for example, a casting mold).

An aluminum base material added with 10% in weight of silicon relative to 90% in weight of pure aluminum has a linear expansion coefficient of $21\times10^{-6}$/K, which is lower than that of pure aluminum. The linear expansion coefficient of the composite material or the base material can be controlled by properly selecting the ratio of silicon to be added. As a result, the composite material or the base material having a desired linear expansion coefficient can be produced.

DESCRIPTION OF THE PREFERRED EMBODIMENT(S)

The present invention will be explained in detail with reference to drawings hereinafter.

EXAMPLE 1

Figure 1A:
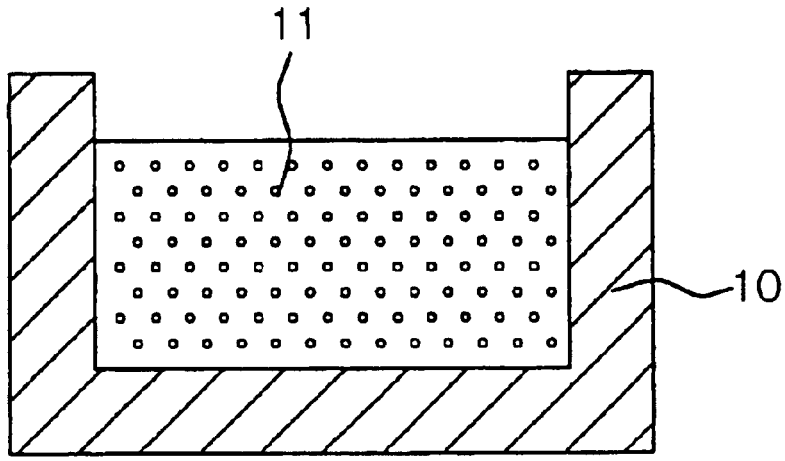
FIGS. 1A and 1B are schematic drawings of the container, etc. for explaining the method for producing the aluminum nitride/aluminum base composite material according to the first aspect of the present invention.
Figure 1B:
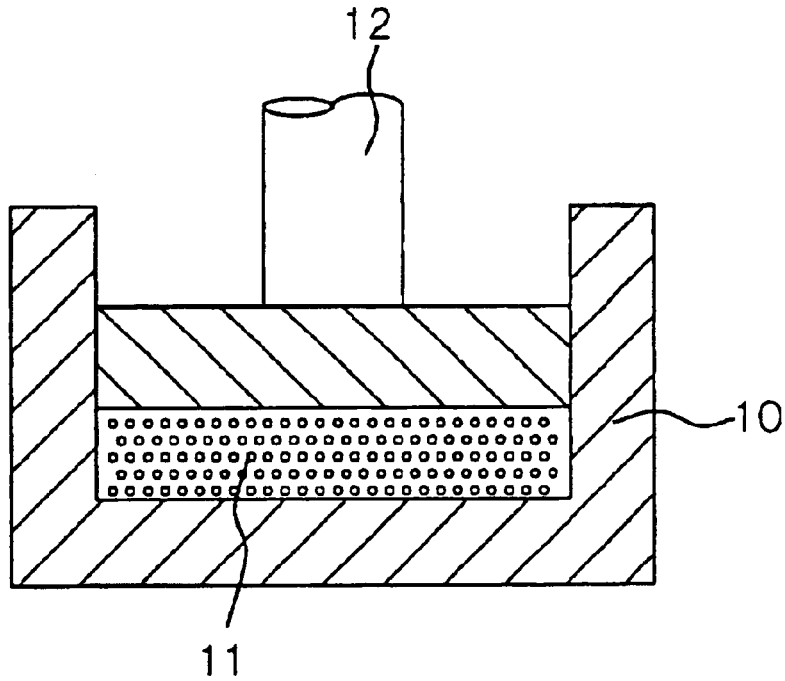

Example 1 relates to the aluminum nitride/aluminum base composite material and the method for producing thereof according to the first aspect of the present invention. In Example 1, as schematically shown in FIG. 1A, aluminum nitride powder 11 was charged (filled) into a container 10 provided in a molten metal press apparatus (not shown). The aluminum nitride powder 11 employed was a mixture of 25% in weight of aluminum nitride powder with an average particle size of 10 $\mu$m and 75% in weight of aluminum nitride powder with an average particle size of 40 $\mu$m. While the aluminum nitride powder 11 in the container 10 was heated at approx. 700° C. using a heater (not shown), an absolute pressure of 100 kgf/cm$^2$ was applied to the aluminum nitride powder 11 in the container 10 using a press machine 12 (see the schematic drawing in FIG. 1B). The aluminum nitride powder 11 was thus densified and solidified to be provided in a desired form.

Figure 2A:
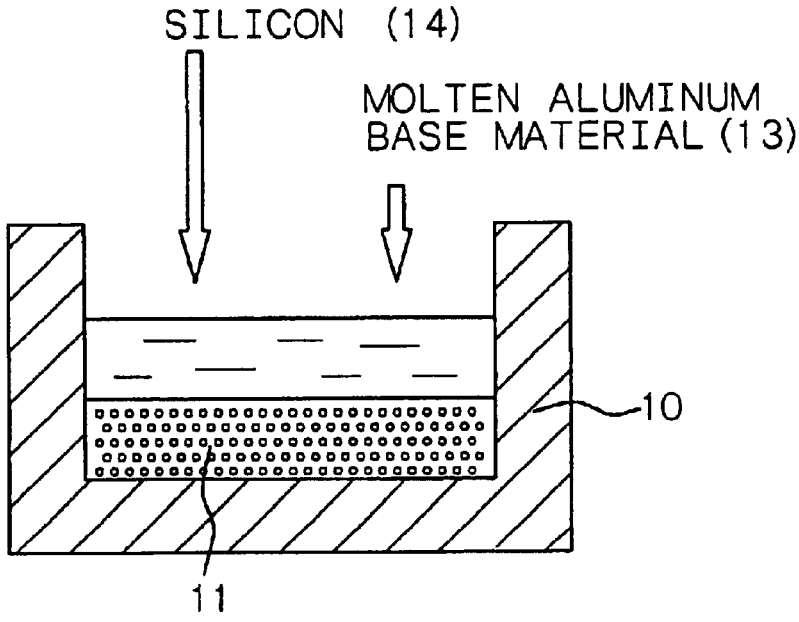
FIGS. 2A and 2B, subsequent to FIG. 1B, are schematic drawings of the container, etc. for explaining the method for producing the aluminum nitride/aluminum base composite material according to the first aspect of the present invention.
Figure 2B:
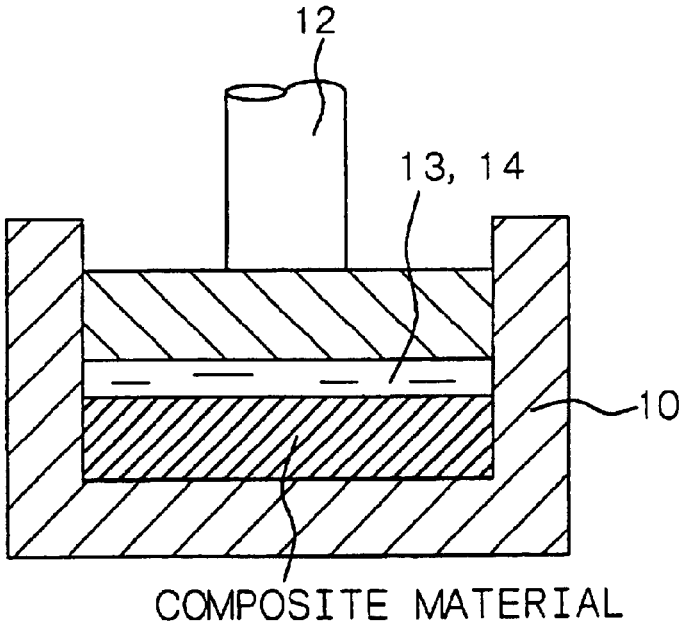

Then, a molten (fused) aluminum base material 13 at approx. 800° C. (pure aluminum employed in Example 1) was poured into the container 10. When the molten aluminum base material 13 was poured into the container 10, lumps of silicon 14 were added (see the schematic drawing in FIG. 2A). A ratio of silicon to be added was set to 25% in weight relative to the pure aluminum set at 75% in weight. Then, the high-pressure casting process was carried out. That is, an absolute pressure of 1 metric ton-f/cm$^2$ was applied to the molten aluminum base-material 13 in the container 10 using the press machine 12 (see the schematic drawing in FIG. 2B). Thus, obtained was an aluminum nitride/aluminum base composite material in which the aluminum base material 13 was immersed and filled in the space between the aluminum nitride powder particles (or in the pores). Thus-obtained composite material had a heat conductivity of as high as 176 W/m·K and a linear expansion coefficient of as low as $6.7\times10^{-6}$/K.

EXAMPLE 2

Figure 3:
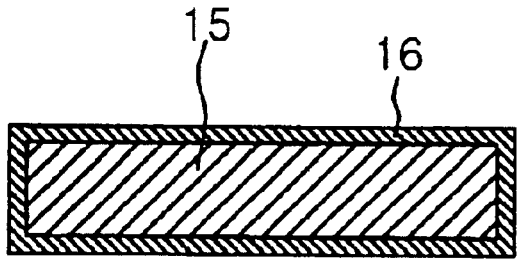
FIG. 3 shows a schematic cross-sectional view of the aluminum nitride/aluminum base composite material obtained by the method for producing the aluminum nitride/aluminum base composite material according to the second aspect of the present invention.

Example 2 relates to the aluminum nitride/aluminum base composite material and the method for producing thereof according to the third aspect of the present invention. In Example 2, the aluminum nitride/aluminum base composite material produced in Example 1 was used as a base material 15, and the surface of this base material 15 was covered with a covering layer 16 consisting of a ceramic material ($Al_2O_3$ employed in Example 2). FIG. 3 shows a schematic cross-sectional view of such a composed aluminum nitride/aluminum base composite material. The covering was performed by a vacuum thermal spraying process. The covering layer 16 consisting of $Al_2O_3$ and having a thickness of approx. 0.2 mm was typically formed on the surface of the base material 15 by the vacuum thermal spraying process. The linear expansion coefficient of $Al_2O_3$ is approx. $8\times10^{-6}$/K, that is, $\alpha_2$ is equal to 8. The linear expansion coefficient of the base material, on the other hand, is $6.7\times10^{-6}$/K. Therefore, the relation of $(\alpha_1-3)\leqq\alpha_2\leqq(\alpha_1+3)$ is satisfied. It is also allowable to form an underlayer consisting of nickel containing aluminum of approx. 5% in weight (Ni-5 wt % Al) on the surface of the base material 15 by a vacuum thermal spraying process, and then to form the covering layer 16 consisting of the ceramic material on the underlayer by the vacuum thermal spraying process.

EXAMPLE 3

Figure 4:
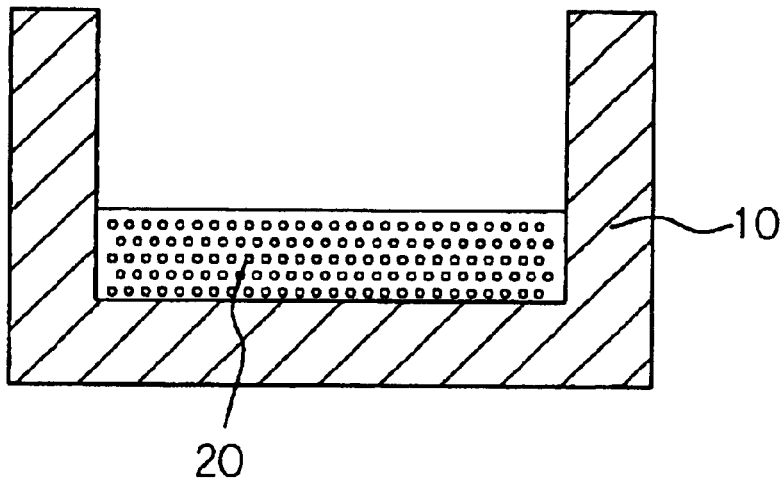
FIG. 4 is a schematic drawing of the container, etc. for explaining the method for producing the aluminum nitride/aluminum base composite material according to the third aspect of the present invention.

Example 3 relates to the aluminum nitride/aluminum base composite material and the method for producing thereof according to the second aspect of the present invention. In Example 3, a preform 20 obtained by sintering aluminum nitride powder was enclosed in the container (casting mold) 10 provided in a molten metal press apparatus (not shown) as schematically shown in FIG. 4. The preform 20 was prepared from aluminum nitride powder with an average particle size of 15 $\mu$m. The preform was formed from the from aluminum nitride powder by the slurry casting process and sintering process at approx. 500° C.

Figure 5A:
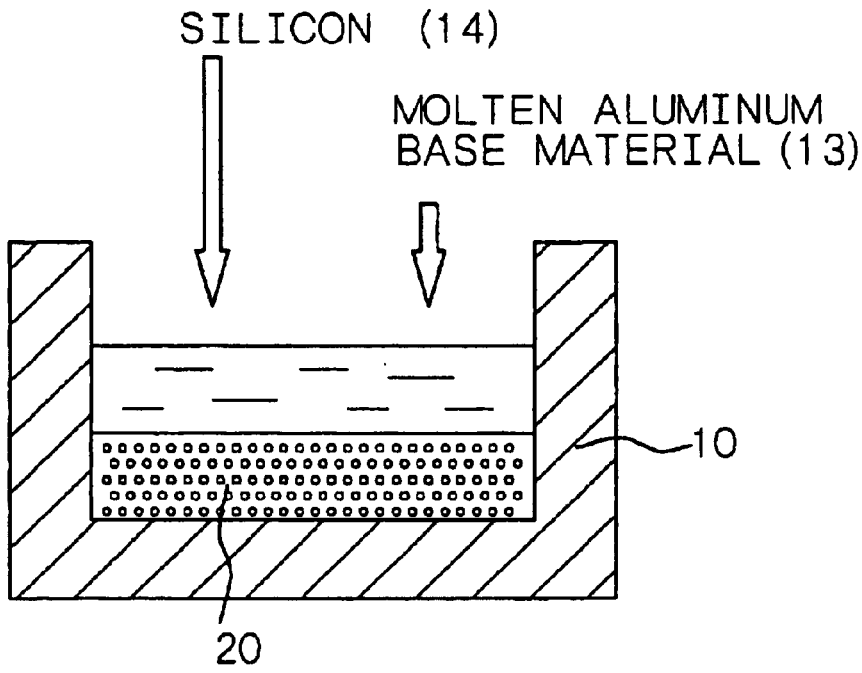
FIGS. 5A and 5B, subsequent to FIG. 4, are schematic drawings of the container, etc. for explaining the method for producing the aluminum nitride/aluminum base composite material according to the third aspect of the present invention.
Figure 5B:
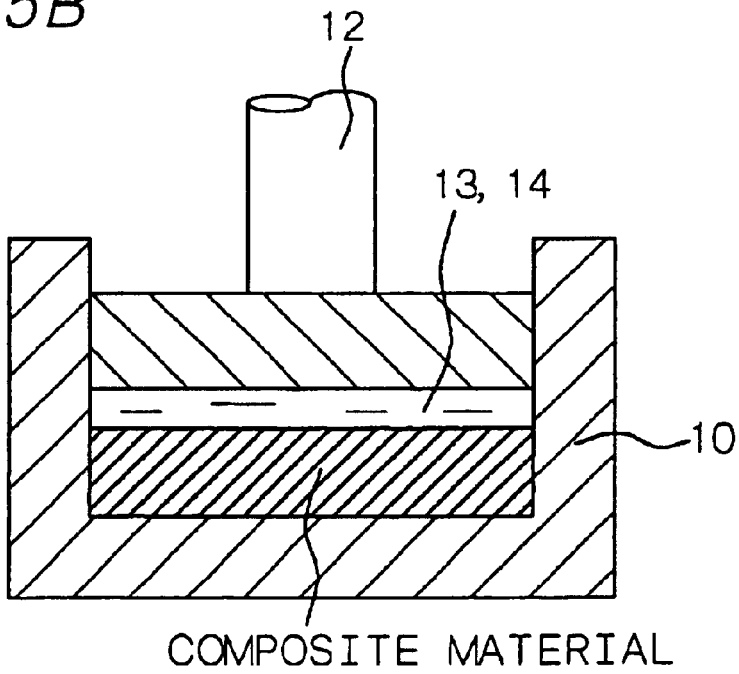

While the preform 20 in the container 10 was heated at around 800° C. using a heater (not shown), a molten (fused) aluminum base material 13 (pure aluminum employed in Example 3) together with silicon lumps of 16% in weight at around 800° C. was poured into the container 10 (see the schematic drawing in FIG. 5A). Then, the high-pressure casting process was carried out. That is, an absolute pressure of 1 metric ton-f/cm$^2$ was applied to the molten aluminum base material 13 in the container 10 using the press machine 12 (see the schematic drawing in FIG. 5B). Thus, obtained was the aluminum nitride/aluminum base composite material in which the aluminum base material was immersed and filled in the pores of the preform 20. The aluminum nitride/aluminum base composite material thus obtained had a heat conductivity of as high as 185 W/m·K and a linear expansion coefficient of as low as $7.3\times10^{-6}$/K.

EXAMPLE 4

Example 4 relates to the aluminum nitride/aluminum base composite material and the method for producing thereof according to the fourth aspect of the present invention. In Example 4, the aluminum nitride/aluminum base composite material produced in Example 3 was used as a base material, and the surface of the base material was covered with a covering layer consisting of a ceramic material ($Al_2O_3$ employed in Example 4). The covering was performed by a vacuum thermal spraying process. The covering layer consisting of $Al_2O_3$ and having a thickness of approx. 0.2 mm was formed on the surface of the base material by the vacuum thermal spraying process. The linear expansion coefficient of $Al_2O_3$ is approx. $8\times10^{-6}$/K, that is, $\alpha_2$ is equal to 8. The linear expansion coefficient of the base material, on the other hand, is $7.3\times10^{-6}$/K. Therefore, the relation of $(\alpha_1-3)\leqq\alpha_2\leqq(\alpha_1+3)$ is satisfied. It is also allowable to form an underlayer consisting of nickel containing aluminum of approx. 5% in weight (Ni-5 wt % Al) on the surface of the base material by a vacuum thermal spraying process, and then to form the covering layer consisting of the ceramic material on the underlayer by the vacuum thermal spraying process.

EXAMPLE 5

A cylinder block for an automotive internal combustion engine was manufactured according to the method for producing the aluminum nitride/aluminum base composite material of Example 1. The obtained cylinder block was found to have a high wear resistance. A piston for an automotive internal combustion engine was also manufactured according to the method for producing the aluminum nitride/aluminum base composite material of Example 2. The surface of the base material was covered with a covering layer consisting of aluminum nitride (AlN) by the vacuum thermal spraying process. Thus obtained piston was found to be largely improved in its durability against thermal load from that of the conventional one, which made the piston less liable to wear. In addition, the difference between linear expansion coefficients $\alpha_1$ and $\alpha_2$ is as small as $2\times10^{-6}$/K, which successfully prevented the piston from being damaged due to the difference between the linear expansion coefficients.

EXAMPLE 6

A board for mounting electronic parts for controlling an automatic fuel injection device for an automotive internal combustion engine, was manufactured according to the method for producing the aluminum nitride/aluminum base composite material of Example 2. The obtained board was found to have a high heat conductivity and high durability, which resulted in improving reliability of the board.

Although the present invention has been described in accordance with several preferred examples, it is understood that the present invention is not limited to the specific examples thereof. The production conditions for the aluminum nitride/aluminum base composite material of the present invention described in the above examples are only exemplary and allow any proper modification. The applicable fields of the aluminum nitride/aluminum base composite material of the present invention described in the above examples are also exemplary, and a wide variety of technical fields can further include robot arms making use of its vibration damping property, a toner fixing (developing) roller of a copying machine making use of its high heat conductivity and high durability, and rocket parts or other space-scientific applications.

The present invention can provide, at a low cost, the aluminum nitride/aluminum base composite material which is excellent in heat resistance, oxidation resistance and corrosion resistance, and which can be suitably used as raw materials for portions or part of structures and products which require a high heat conductivity and a low linear expansion coefficient. Employing the method for producing the aluminum nitride/aluminum base composite material according to the first or third aspect of the present invention can surely prevent the aluminum nitride/aluminum base composite material from generating cracks, which leads to an improved production yield. Since the linear expansion coefficient of the aluminum nitride/aluminum base composite material is controllable depending upon the ratio of silicon to be added, it is possible to a certain extent to produce the aluminum nitride/aluminum base composite material so as to have a desired linear expansion coefficient.

What is claimed is:

1. An aluminum nitride/aluminum base composite material, which comprises:

(a) a base material obtained by preparing a preform having pores, obtained by sintering aluminum nitride powder, enclosing the preform in a container provided in a molten metal pressure apparatus, pouring a molten aluminum base material into the container, and, applying pressure to the molten aluminum base material in the container to fill the aluminum base material in the pores of the perform;

(b) a covering layer consisting of a ceramic material and covering a surface of the base material; and (c) an intermediate underlayer, disposed between said base material and said covering layer, said intermediate layer comprising nickel containing approximately 5% weight aluminum, wherein the base material and the covering layer satisfy the relation of $$(\alpha_1-3)\leqq\alpha_2\leqq(\alpha_1+3), \text{ and}$$

wherein $\alpha_1$ is the linear expansion coefficient of said base material and $\alpha_2$ is the linear expansion coefficient of said covering layer [unit: $10^{-6}$/k].

2. The aluminum nitride/aluminum base composite material according to claim 1, wherein the molten aluminum base material is poured into the container, together with silicon lumps.

3. The aluminum nitride/aluminum base composite material according to claim 1, wherein the ceramic material constituting the covering layer is $Al_2O_3$ or aluminum nitride.

4. An aluminum nitride/aluminum base composite material, which comprises:

(a) a base material obtained by preparing a preform having pores, obtained by sintering aluminum nitride powder, enclosing the preform in a container provided in a molten metal pressure apparatus, pouring a molten aluminum base material into the container, and, applying pressure to the molten aluminum base material in the container to fill the aluminum base material in the pores of the perform;

(b) a covering layer consisting of a ceramic material and covering a surface of the base material; and (c) an intermediate underlayer, disposed between said base material and said covering layer, said intermediate layer comprising nickel containing approximately 5% weight aluminum.

5. The aluminum nitride/aluminum base composite material according to claim 4, wherein the molten aluminum base material is poured into the container, together with silicon lumps.

6. The aluminum nitride/aluminum base composite material according to claim 4, wherein the ceramic material constituting the covering layer is $Al_2O_3$ or aluminum nitride.

* * * * *

UNITED STATES PATENT AND TRADEMARK OFFICE

CERTIFICATE OF CORRECTION

PATENT NO. : 6,805,973 B2
DATED : October 19, 2004
INVENTOR(S) : Shingo Kadomura et al.

It is certified that error appears in the above-identified patent and that said Letters Patent is hereby corrected as shown below:

Column 9,
Line 39, “perform” should read -- preform --.

Column 10,
Line 29, “perform” should read -- perform --.

Signed and Sealed this

Nineteenth Day of April, 2005

JON W. DUDAS
*Director of the United States Patent and Trademark Office*